US005468090A

United States Patent [19]

Brombach

[11] Patent Number: 5,468,090

[45] Date of Patent: Nov. 21, 1995

[54] BENDING WEIR

[76] Inventor: Hansjoerg Brombach, Von-Berlichingen-Strasse 21, D-6990 Bad-Mergentheim-Neunkirchen, Germany

[21] Appl. No.: 90,710

[22] Filed: Jul. 13, 1993

[30] Foreign Application Priority Data

Jul. 15, 1992 [DE] Germany ..... 42 23 259.7

[51] Int. Cl.[6] ..... E02B 7/44

[52] U.S. Cl. ..... 405/94; 405/100; 405/101

[58] Field of Search ..... 405/87, 93, 94, 405/98, 100, 101

[56] References Cited

U.S. PATENT DOCUMENTS

| | | | |
|---|---|---|---|
| 1,039,072 | 9/1912 | Edge | 405/94 |
| 2,073,956 | 3/1937 | Becher | 405/101 |
| 2,192,510 | 3/1940 | Smith . | |
| 2,598,389 | 5/1952 | Jermar | 405/94 |
| 2,609,666 | 9/1952 | Mesnager . | |
| 4,505,612 | 3/1985 | Shelley | 405/101 |
| 4,787,774 | 11/1988 | Grove | 405/94 |
| 5,222,834 | 6/1993 | Schultz | 405/94 |

FOREIGN PATENT DOCUMENTS

| | | | |
|---|---|---|---|
| 193808 | 12/1957 | Austria | 405/100 |
| 218965 | 1/1962 | Austria | 405/100 |
| 0379327 | 7/1990 | European Pat. Off. . | |
| 257804 | 3/1913 | Germany . | |
| 684222 | 11/1939 | Germany . | |
| 1109098 | 6/1961 | Germany | 405/87 |
| 1119779 | 12/1961 | Germany | 405/100 |
| 1252595 | 10/1967 | Germany . | |
| 2911780 | 10/1980 | Germany . | |
| 3305409 | 8/1984 | Germany . | |
| 3520695 | 6/1985 | Germany . | |
| 8510517 | 4/1987 | Germany . | |
| 3619995 | 12/1987 | Germany | 405/87 |
| 822154 | 4/1981 | U.S.S.R. | 405/94 |

OTHER PUBLICATIONS

DE–Z: Industriereport '85, Sonderbeilage der Wasserwirtschaft, S.35.

*Primary Examiner*—John A. Ricci
*Attorney, Agent, or Firm*—Quarles & Brady

[57] ABSTRACT

A flap weir with a base wall arranged between two side walls, a flap is fixed and sealed in a non-rotary manner by one longitudinal edge to the base wall, the other longitudinal edge forming an overflow edge. The flap is modified by natural deformation occurring as a result of the action of increased water pressure bearing on it.

20 Claims, 3 Drawing Sheets

BENDING WEIR

Figure 1:
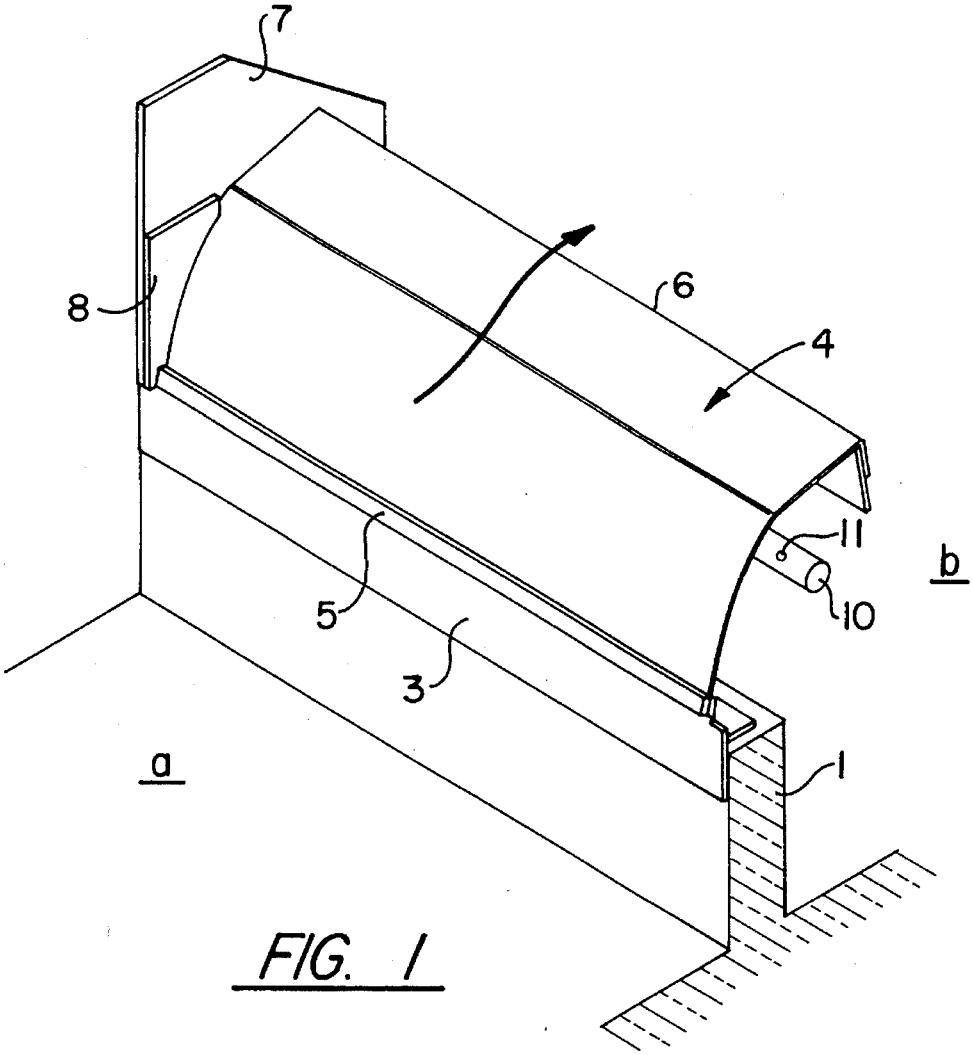

The invention relates to a flap or lever weir, particularly for a rain water discharge means in a combined sewer system.

Rain water discharge means in combined sewer systems are used for discharging the excess water into the main drainage channel when a clearly defined, maximum water level is exceeded, so as to avoid any overloading of the sewage treatment plant and limit the damming up in the sewer system.

However, the presently conventional, fixed overflow weirs suffer from the disadvantage that in the case of small overflow heads they only have a limited efficiency. Therefore, as a result of the predetermined backwater level, the overflow crests must be made very long.

Attempts have already been made to use weirs having a movable overflow edge, so-called weir flaps. These are pivotable flaps or displaceable gates, the water flowing either over or under them. They are driven by servodrives, so that an external energy source must be connected thereto. There are also flaps which are provided with counterweights, so that they open under the upstream pressure of the water. However, a control or regulation is very difficult and due to the many mechanically movable parts, such as rolls, pulleys, rope guides, etc., said flaps are very complicated and have a high hysteresis, or tend to be subject to uncontrolled regulating oscillations.

The problem of the invention is to provide a flap or lever weir, which in the case of simple construction, allows an optimum utilization of a combined storm overflow structure.

According to the invention this problem is solved by a flap or lever weir having various new and useful features.

Therefore the invention proposes a closure between the weir and the laterally positioned side walls, which is in the form of an element, which is not a flap in the conventional sense, because it is not pivotably articulated about an axis in the manner of a conventional flap. Instead the flap is a bending weir in form of a stiff spring, which is moved by the upstream water pressure. This spring is not susceptible to oscillation, because the water mass load on it brings a considerable damping action. The sealed, fixed connection with the longitudinal base has the advantage that no complicated seals are required as in the case of a conventional flap over which the water flows. The only movement which occurs in the case of the bending weir proposed by the invention is a deformation and distortion of the flap, so that there is no need for the hitherto used bearings, counterweights, floats, pulleys, ropes, etc.

The deformation of the flap and therefore the movement of the overflow edge is solely brought about by the pressure differential from upstream to downstream and the natural elasticity of the flap material.

In order that the flap responds particularly sensitively and rapidly, according to the invention in the closed state it may diverge slightly from the vertical in the opening direction and consequently in the closed state it slopes slightly in the opening direction.

It has been found to be particularly advantageous if in the undeformed state, i.e. that not exposed to the upstream water pressure, the flap is arranged so as to diverge with respect to the vertical by an angle of approximately 15°.

According to a further development of the invention the flap has an area emanating from its overflow edge and which is flatter or more shallow than the lower part. In the undeformed state said flatter area can advantageously form an angle between 50° and 55° with the horizontal.

As soon as the upstream water pressure rises and the flap deforms, there is also a natural change to the angle of said flatter area. According to the invention in the case of a relief or discharge water level the flatter area assumes an angle of approximately 15° to the horizontal.

The flatter area can e.g. be planar, but this is not necessary. The invention proposes that the flatter area can be separated from the remaining area of the flap by a pronounced kink.

According to a further development of the invention, at least in its area connected to the fixed edge, the flap is preferably prebraced bent in the inoperative state. The deformation of the flap fixed by one edge is naturally a more or less pronounced bending. The prebracing is selected in such a way that the natural bending form is predetermined, at least in the lower area.

According to the invention the flap, at least in its area connected to the lower fixed edge, in the inoperative state engages with the marginal area of its top or front flat on a step or the like, which can be provided with a seal or packing. The flat engagement of the top leads to a packing which is scarcely subject to wear, because the opening of the flap by deformation means that the flap moves away perpendicular to the packing plane. Thus, there is no sliding packing, such as is the case with conventional pivotable flaps. Sliding packings are subject to static friction, which leads to hysteresis.

According to the invention the flap has a flatter area connected to the predeformed area, which extends up to the overflow edge. This optionally planar, non-prebraced area runs e.g. at an angle of 15° to the horizontal when the flap weir is closed.

According to the invention, the bent, prebraced area is separated from the planar area by a kink. As the flap is made from commercial, stainless spring steel, the metal plate need only be provided with this single kink, because the predeformation in the fitted state is brought about by a contact surface.

According to a further development of the invention, the flap has at the overflow edge a marginal strip bent round approximately at right angles and which serves to improve the stability and leads to a good flow separation in the vicinity of the overflow edge. According to a further development in the lateral end region of the flap there can be a stiffening plate on the marginal strip and which is either constructed in one piece with the flap or is fixed to the latter. According to a further development below or behind the flap is provided an aerating device, which prevents the formation of an underpressure below the flap and therefore reduces flap hysteresis and tendency to oscillate.

The aerating device can in particular be an aerating pipe parallel to the fixing edge of the flap and which has a plurality of aerating openings, the aerating pipe issuing in the vicinity of its two ends at points on the other side of the weir side walls.

According to a further development of the invention the aerating pipe is arranged in such a way that it forms a stop for the flap. It can in particular be provided that the aerating pipe is positioned in such a way that in its stop position the flap engages with its kink on the pipe.

For the easier fitting of the flap an approximately T-shaped beam can be provided, which is bolted to the inside of the base wall and on whose one leg is riveted or screwed one edge of the flap.

The bending flap weir proposed by the invention makes it possible to lift the relief water level in the case of a constant overflow length and the same maximum water level. It is an automatically operating mechanism and requires no outside energy. It does not require movable bearings, which leads to increased operational reliability, reduced susceptibility to wear and long life.

The bending flap weir proposed by the invention can be subsequently fitted in existing storm water discharge structures.

The invention is described in greater detail hereinafter relative to a nonlimitative embodiment and with reference to the attached drawings, wherein show:

FIG. 1 In simplified form a perspective view of a bending flap weir according to the invention in the inoperative state.

Figure 2:
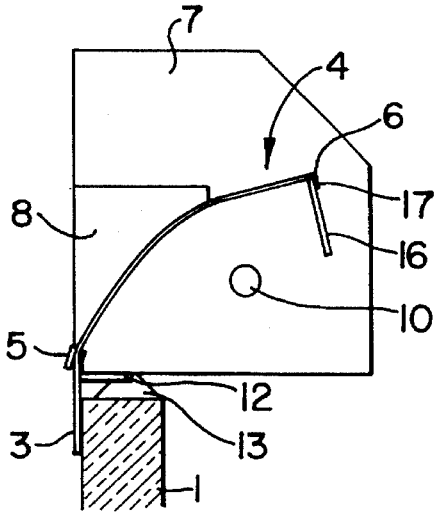

FIG. 2 In simplified form a cross-section through the flap weir in the inoperative state.

Figure 3:
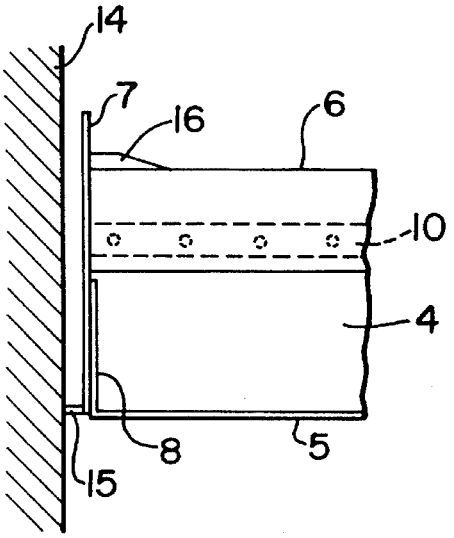

FIG. 3 A partial plan view of the bending flap weir.

Figure 4:
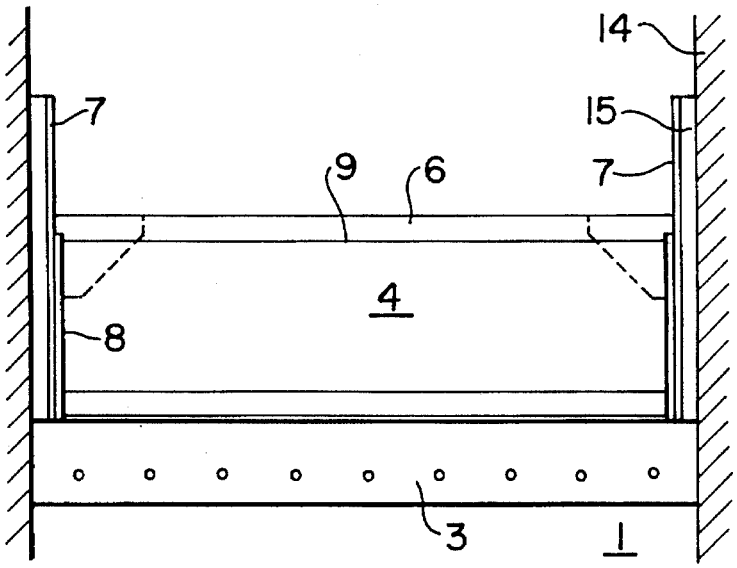

FIG. 4 A front view from the front left in FIG. 1.

FIGS. 5*a–e* The position of the bending flap weir in different opening stages.

Figure 6:
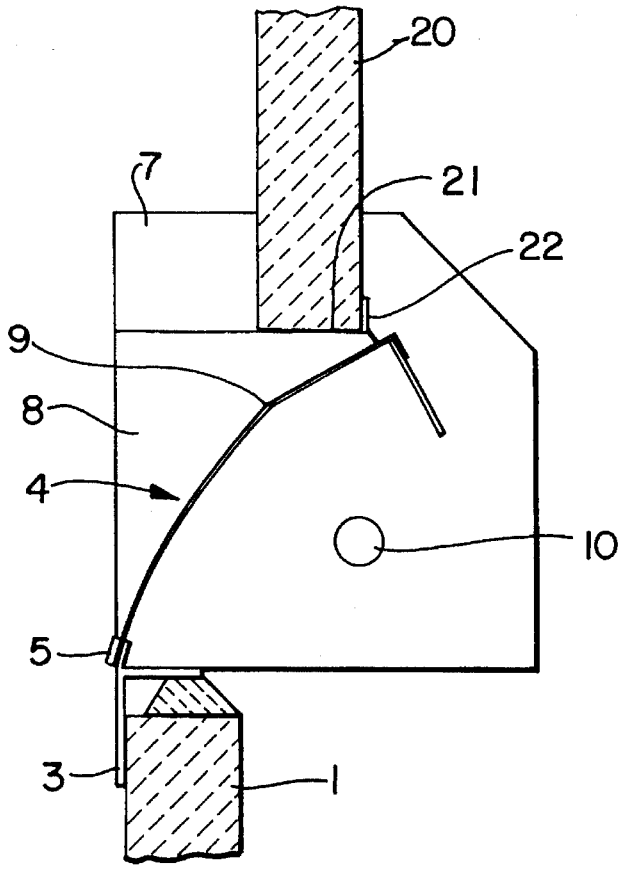

FIG. 6 A representation corresponding to FIG. 2 in which the bending flap weir is used as a back flow preventer.

Figure 7:
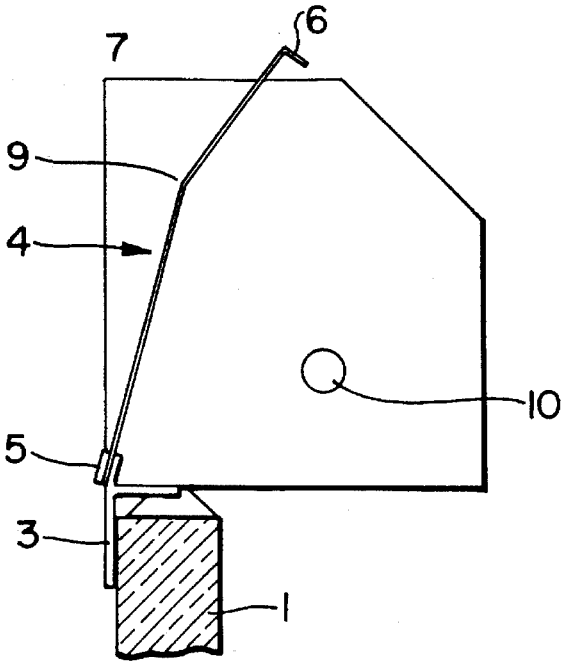

FIG. 7 A representation corresponding to FIG. 2 of a second embodiment of a flap weir.

FIG. 1 is a perspective section showing a base wall 1 of a storm water overflow structure and which has a horizontal upper edge 2. From the space a in front of the overflow 1 in the case of an excessive water inflow, the water is intended to flow from the storm water discharge structure over the wall 1 and into a storm outlet b to the receiving water. To the wall 1 is bolted a metal beam 3, which is approximately T-shaped in cross-section. To the upper edge of the beam 3 is fixed with the aid of an upstream ledge 5 and e.g. by screwing or riveting, one edge of a flap 4. The corresponding leg of the T-beam 3 is bent rearwards by an angle of e.g. 15°, so that the flap 4 already has a direction diverging from the vertical.

The flap 4 extends upwards and rearwards until an overflow edge 6 is formed, which runs parallel to the edge at which the flap 4 is fixed to the beam 3. The flap 4 extends frontally on either side up to a side wall 7, whereof only the left-hand side wall 7 is visible in FIG. 1.

On the inside of the side wall 7 a preloading plate 8 is fitted upstream of the flap 4 and forms a shoulder facing said flap 4, on which the flap 4 engages flat with its front or top side in the marginal area. The flap also can be hindered to swing back to the upstream area by two bolts x on both sides of side walls.

The flap 4 has two areas separated from one another by a kink 9. The area emanating from the fixing edge on the base wall 1 is slightly curved as a result of its engagement on the preloading plates 8 or bolts x, whereas the area running from the kink and extending to the overflow edge 6 is planar in the initial flap state.

In the area below the flap 4 is arranged a pipe 10, which runs parallel to the wall 1 and the overflow edge 6. The pipe 10 is an aerating pipe and is provided with a row of aerating holes 11.

FIG. 2 shows the arrangement in cross-section. The T-beam 3 is so fixed to the wall 1 that its horizontally rearwardly directed leg 12 has a certain spacing from the upper edge of the wall 1. In this space is placed mortar for forming a joint 13, which seals the T-beam 3 relative to the base wall and passes compressive forces from the beam to the base wall.

The preloading plates 8 are approximately shaped like a right-angled triangle, whose hypotenuse is slightly curved. The curvature corresponds to the shape of the plate as flap relief takes place. This means that the flap 4 in its area extending up to the kink 9 is already mechanically preloaded. Therefore there is no permanent prestraining of the plate of the flap 4 and instead there is a preloading or pretensioning.

The sealing between the flap 4 and the side walls takes place in the vicinity of the preloading plates 8, e.g. in that on the bent underside of the plate 8 is provided a packing on which presses flat the preloaded flap 4. The planar area of the flap 4, which is relatively flat, need not be sealed by packings with respect to the side walls 7, because the slits between the flap and the side walls are narrow and with a rising water level the flap soon tilts over.

In case a certain leakage of the flap is acceptable, the preloading plates 8 can be replaced by simple stopper bolts or the like.

FIG. 3 shows a plan view of the arrangement. The side wall 7 is fitted a certain distance upstream of the masonry 14. In the front area said gap is sealed by a lateral packing 15. The aforementioned aerating pipe 10 extends into an opening of the side wall 7 and is fixed therein. Therefore air can pass from the space between the side wall 7 and the masonry 14 into the interior of the pipe 10 and then through the aerating openings 11 below the flap 4.

To the front end of the overflow edge 6 of the flap is fitted a stiffening plate 16, which can optionally be adjusted in the longitudinal direction of the flap 4. FIG. 2 shows the fitting of this stiffening plate 16 to a bent stiffener 17 of the flap plate 4. These plates 16 and stiffener 17 prevent tilting of the flap.

The front view of the flap weir in FIG. 4 shows the arrangement of the flap 4 between the two side walls, so that it is clear that the flap 4 seals the gap between the two side walls 7, the base wall 1 and its upper edge 6.

Figure 5A:
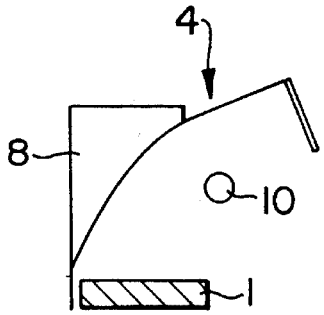
Figure 5B:
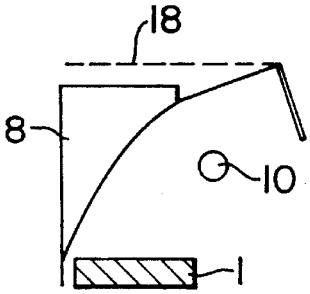
Figure 5C:
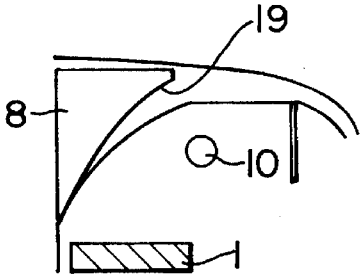
Figure 5D:
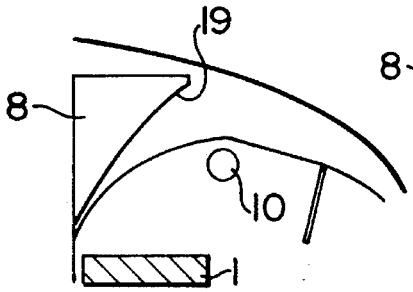
Figure 5E:
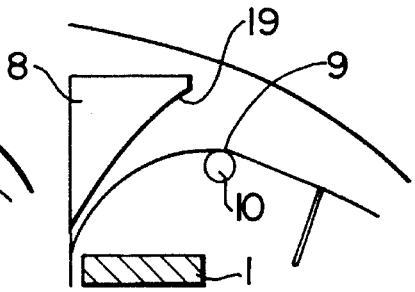

FIGS. 5*a–e* diagrammatically shows the bending weir in different states. FIG. 5*a* shows the closed state, in which the water has not yet opened the flap. The flap 4 is shaped in the manner shown in FIG. 2. FIG. 5*b* shows in broken line form the upstream water level 18. At this water level there is an equilibrium between the preloading of the flap 4 and the static forces of the water. As soon as the water level is reached or exceeded, there is a downward deformation of the flap 4, so that the flap 4 is released from the shoulder 19 formed on the underside of the preloading plate 8. Simultaneously the planar area of the flap 4 passes into an even flatter to horizontal position. As a result of the deformation a different water body is formed above the bending plate, which now brings about a further deformation. This leads to positive feedback and rapid movement of the bending plate until a new equilibrium occurs. FIG. 5*d* shows the flap 4 in a further deformed state, whereas in FIG. 5*e* the flap 4 engages with its kink 9 on the aerating pipe 10.

If the upper water level drops again, the flap 4 can right itself until it has finally again assumed the position shown in FIG. 5*a*, because the aerating pipe 10 prevents the formation of a suction below the flap.

FIG. 6 shows an installation in which above the base wall 1 is provided an upper wall 20 with a lower edge 21. On the back of the lower edge 21 is provided a sealing strip 22, which engages on the top of the closed flap 4. With this fitting type the flap weir can also serve as a back flow preventer. In this case the preloading plates are continued over the entire length of the flap.

The same references are used in the case of the embodiment of FIG. 7 for parts which are identical with the preceding embodiments. FIG. 7 roughly corresponds to FIG. 2 and shows the bending flap weir in a state where no water is in engagement with the flap 4. The flap 4 is fixed to the base wall 1 in the same way, i.e. with a T-section 3. The upper leg to which the flap 4 is fixed with the aid of the ledge 5, is inclined somewhat relative to the vertical, namely by an angle of 15°. In this embodiment no preloading plates 8 are fitted to the side wall 7, so that the flap 4 extends in planar manner in the upwards direction. To the first planar portion, separated by the kink 9, is connected a second, flatter portion, which leads up to the overflow edge 6. The somewhat flatter area between the overflow edge 6 and the kink 9 is at an angle of approximately 50° to 55° with respect to the horizontal. If the water level rises, the flap 4 is deformed in the area exposed to the water and the deformation is in the form of a distortion. In the case of the latter the area between the kink 9 and the upper edge 6 becomes ever flatter until also in this embodiment on reaching the discharge water level the shape of the flap 4 shown in FIG. 2 is obtained. In this state shortly preceding the overflow, the flatter part is at an angle of approximately 15° to the horizontal.

Whereas in the embodiment according to FIGS. 1 to 5 a seal is provided between the preloaded part of the flap 4 and the side walls 7 by an engagement of the flap on the underside 19 of the preloading plate 8, in the embodiment of FIG. 7 a sealing action can be brought about in a different way. It can firstly be sufficient for the flap 4 to be guided up to a short distance upstream of the side walls 7, so that a narrow gap is formed through which some water can flow. An absolute seal is not required. However, it is also possible to use conventional sealing strips. The flatter area of the flap 4 between the kink 9 and the overflow edge 6 need not be sealed, because if the water rises to such an extent that it could flow through there, then the flap is about to tilt over.

What I claim is:

1. A flap weir for controlling water flow in response to water pressure, the weir comprising:

a horizontal base wall;

two side walls laterally bounding the base wall;

a flap having front and rear oppositely facing surfaces, the flap being sealingly fixed by a fixed edge in unrotatable manner to the base wall so that a free edge opposite the fixed edge forms an overflow edge, the flap extending laterally up to the side walls such that the passage of water laterally between the flap and the side walls is negligible;

wherein, when undeformed, the flap assumes a closed position, the position of the overflow edge being modified when the flap is deformed; and wherein said flap is constructed of a resilient material of uniform thickness that is yieldable in an opening direction in response to a predetermined water pressure, said flap storing a spring force when in the open position, said spring force returning said flap to the closed position when said water pressure is reduced below said predetermined water pressure.

2. A flap weir according to claim 1, wherein a flat portion of the flap adjacent the overflow edge is flatter than other portions of the flap.

3. A flap weir according to claim 2, wherein the flatter area is separated from the other portions by a kink.

4. A flap weir according to claim 3 wherein, when in the closed state, a preloaded area of the flap adjacent the fixed edge is preloaded in a bent position.

5. A flap weir according to claim 4, wherein the flat portion is connected to the preloaded area.

6. A flap weir according to claim 4, wherein, the preloaded area assumes an open orientation when the flap is in the open position and the preloaded area is preloaded in the open orientation.

7. A flap weir according to claim 1, wherein a stiffening element is provided in the vicinity of the overflow edge.

8. A flap weir according to claim 1 wherein an aerating device is provided adjacent the flap, the flap bending over the aerating device when the flap is deformed.

9. A flap weir according to claim 8 wherein the aerating device comprises an aerating pipe parallel to the overflow edge.

10. A flap weir according to claim 9 wherein the aerating pipe is connected and traverses the distance between the two side walls.

11. A flap weir according to claim 9 wherein the aerating pipe forms a stop for the flap.

12. The bending weir according to claim 1 wherein the bending flap is made from a metal sheet.

13. A flap weir according to claim 1, wherein, when a volume of water bears on the front surface, the flap deforming to different degrees solely as a function of the water pressure on the front surface.

14. The flap according to claim 13, wherein, the flap, when in the closed state, deviates from a vertical plane in the opening direction.

15. A flap weir according to claim 14, wherein the flap, when in the closed state, is in a fixed position at an angle of approximately 15 degrees from a vertical plane.

16. A flap according to claim 15 wherein, at a maximum water pressure level the flap assumes an open position where water first begins to pass over the flap, wherein the flap includes a kink positioned at a flap high point when the flap is in the open position.

17. A flap weir according to claim 16 wherein an aerating device is provided below the flap when the flap is in the open position, the aerating device contacting the flap and forming a stop for the flap when the flap is in the open position.

18. A flap weir according to claim 14 further including two opposing preloading plates, one plate positioned on each side wall, each plate having a sealing edge which engages an adjacent edge of the flap along the front surface.

19. A flap weir according to claim 14, the flap further including a marginal strip which extends at approximately a right angle from the overflow edge in the opening direction, wherein the strip stiffens the free edge.

20. A flap weir according to claim 1 further including a T-beam for fixing the flap to the base wall, the T-beam having a base member and two extensions, the base and one extension forming a channel for securely receiving an upper edge of the base wall, the fixed edge being securely connected to the second extension.

* * * * *